United States Patent [19]

Zacharatos et al.

[11] Patent Number: 4,907,004

[45] Date of Patent: Mar. 6, 1990

[54] POWER VERSATILE SATELLITE TRANSMITTER

[75] Inventors: John Zacharatos, Beaconsfield; Robert B. Williamson, Pointe Claire, both of Canada

[73] Assignee: Spar Aerospace Limited, Ontario, Canada

[21] Appl. No.: 197,328

[22] Filed: May 23, 1988

[51] Int. Cl.[4] ..... H01Q 3/22

[52] U.S. Cl. ..... 342/373; 342/382; 342/354

[58] Field of Search ..... 342/373, 382, 354

[56] References Cited

U.S. PATENT DOCUMENTS

| | | | |
|---|---|---|---|
| 4,414,550 | 11/1983 | Tressett | 342/373 |
| 4,638,317 | 1/1987 | Evans | 342/373 |
| 4,652,879 | 3/1987 | Rudish et al. | 342/373 |

OTHER PUBLICATIONS

"An Adaptive Multiple Beam System Concept", *IEEE Journal of Selected Areas in Communications*, vol. SAC-4, No. 5, May 1987, by Egami and Kawai.

*Primary Examiner*—Theodore M. Blum
*Assistant Examiner*—David Cain
*Attorney, Agent, or Firm*—Fisher, Christen & Sabol

[57] ABSTRACT

A communications satellite has several radiating elements connected respectively to the output ports of a hybrid matrix power amplifier the input ports of which are connected to respective output ports of a low level beam forming network. The low level beam forming network has input ports to which are applied individual beam signals and these are combined within the network to provide at the network output ports different component sums of the input signals. By selecting appropriate connections between the beam forming network and the hybrid matrix power amplifier on the one hand and between the hybrid matrix power amplifier and the radiating elements on the other hand, desired beam overlap and equal power amplifier loading can be achieved.

11 Claims, 4 Drawing Sheets

POWER VERSATILE SATELLITE TRANSMITTER

BACKGROUND OF THE INVENTION

This invention relates to satellite communications and, more particularly, to an improved transmitter section of a communications satellite.

A fundamental requirement of the design of communications satellites is the efficient use of the available RF power. This requirement becomes even more important in the design of power intensive mobile satellite systems. Such mobile systems use low gain omni antennas on the mobile and require a high EIRP (effective isotropically radiated power) and G/T (gain/temperature ratio) on the satellite to provide satisfactory performance. This performance is obtained by means of high gain spot beams on the spacecraft with area coverage obtained with multiple spot beams. Since the traffic density is non-uniform on the ground some beams will carry more traffic and require more power than other beams. Because the traffic distribution is expected to vary with time and may not be known before the satellite is launched, it is very desirable to be able to move power from one beam to another, while the satellite is in orbit, to maximize the use of the spacecraft resources.

An important spacecraft parameter is the minimum antenna gain at the cross over point between beam. This gain is maximized if the distance between beam centers is kept small and is normally accomplished by a beam forming network followed by a separate power amplifier driving each antenna radiating element. This allows each beam to be formed by a cluster of elements with the cluster for adjacent beams sharing some of the elements. Such a system has no capability of moving power from one beam to another unless a complicated switching system is implemented.

A low level beam forming network followed by the power amplifiers has an additional penalty when the amplifiers are unequally loaded. The phase and gain performance of a power amplifier depend upon the operating power level of the amplifier. Thus if amplifiers driving different elements of a beam cluster have different power levels, because some amplifiers carry signals for adjacent beams, the phase and amplitude at the antenna radiating elements will depart from ideal causing a loss in antenna gain.

An improvement to this arrangement is described by Egami and Kawai in an article entitled "An Adaptive Multiple Beam System Concept" published in the IEEE Journal on Selected Areas in Communications, Vol. SAC5, No. 4, May 1987 incorporated herein by reference. In the system described in that article they introduce a hybrid matrix before the power amplifiers and an inverse hybrid matrix between the power amplifiers and the radiating elements. A signal introduced at a single input port is equally divided between all the amplifiers by the input hybrid matrix and then directed to a single radiating element by the inverse hybrid matrix. There is a one to one correspondence between the input ports and the radiating elements with the power equally divided between the power amplifiers in all cases. This arrangement provides complete flexibility of moving power between beams. However, the system is limited to the use of a single radiating element for each beam which gives a wide separation between beams and a low cross over antenna gain.

This invention describes how the concept of overlapping feed clusters can be combined with the hybrid matrix transponder thus maximizing the antenna gain at the cross-over point while retaining flexible power distribution capability.

As discussed previously, mobile satellite systems will be power intensive systems requiring new solutions to the problem of efficient utilizations of power. Such solutions will have to achieve both optimum antenna gain and power assignment flexibility between beams.

SUMMARY OF THE INVENTION

The present invention succeeds in providing both optimum overall coverage area gain and almost unlimited power assignment flexibility. It does this by succeeding to combine the following two powerful design techniques:

(a) Low Level Beam Forming (LLBF)

(b) Hybrid Matrix Power Amplifier (HMPA)

In summary, the invention provides an overlapping beam, power versatile system for a communications satellite, comprising a low level beam forming network having inputs to which a plurality of individual beam signals are respectively applied, the beam forming network having a plurality of outputs, some of which respectively carry the sum of components of more than one input signal, a hybrid matrix power amplifier having input ports respectively connected to the outputs of the low level beam forming network and having complementary output ports respectively connected to a plurality of radiating elements of the same number as the outputs of the beam forming network, the manner in which the beam signals are combined within the beam forming network, the connections between the outputs of the beam forming network and the input ports of the hybrid matrix power amplifier and the connections between the output ports of the hybrid matrix power amplifier and the radiating elements being determined to achieve equal power amplifier loading and to achieve beam overlap.

DESCRIPTION OF THE PREFERRED EMBODIMENTS

Figure 1:
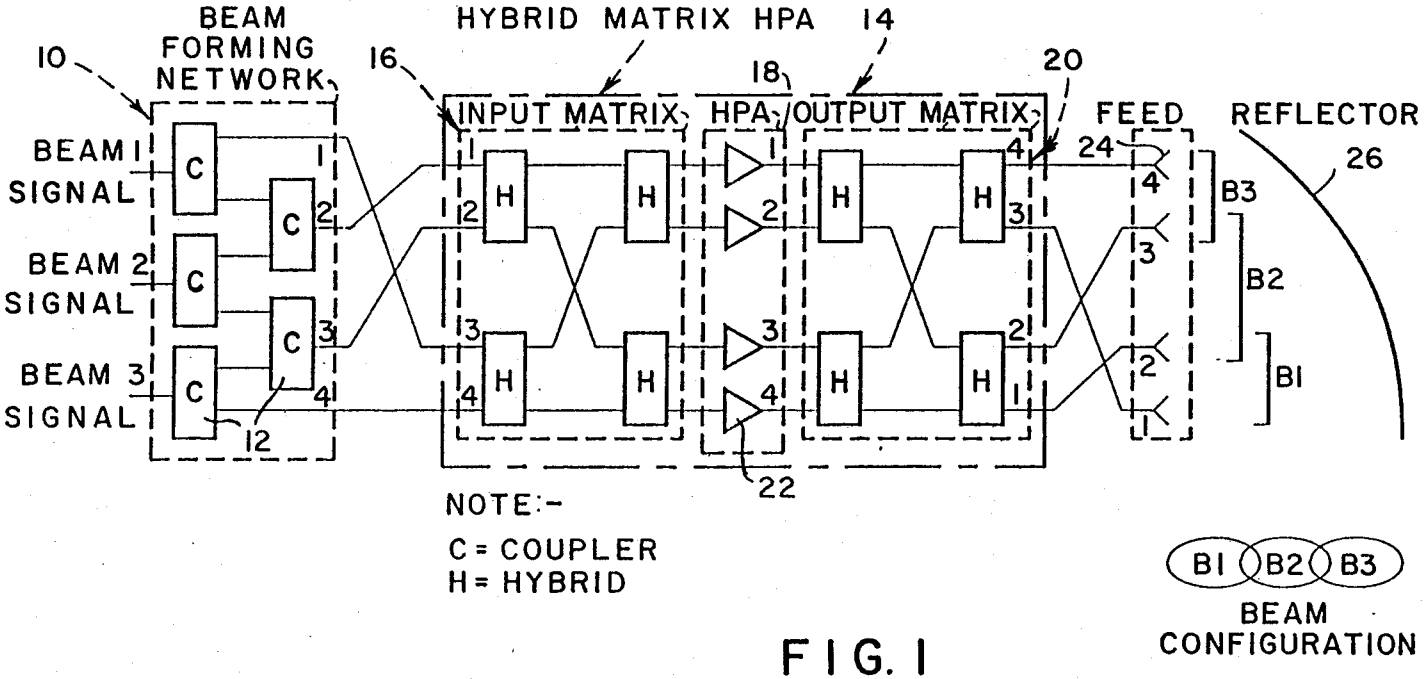
FIG. 1 shows schematically the basics of a system according to the invention.

The system shown in FIG. 1 is a simplified hypothetical 3 beam system. A low level beam forming network (LLBFN) 10 has three input ports and four output ports interconnected by couplers 12. Three beam signals each having a unique frequency are applied, respectively to the three input ports of LLBFN 10. The couplers 12 are arranged so as to divide the beam signals each into two components and then combine selected ones of the individual signal components into a single output port. Specifically, it will be understood by tracing the signal paths from the three inputs to LLBFN outputs 1, 2, 3 and 4 that only a portion of signal 1 appears at output 1, portions of signals 1 and 2 appear at output 2, portions of signals 2 and 3 appear at output 3 and only a portion of signal 3 appears at output 4.

The two signal components of each beam are independently phased and level adjusted within the LLBFN 10 so as to reach the output ports at the same phase and level. What the LLBFN achieves then is to process the original beam signals into an arrangement whereby signals from two beams can be combined into a common radiating element. The co-existence of two beam signals on a single radiating element generates beam overlap at that point.

The outputs from the LLBFN 10 are appropriately connected to the input ports of a hybrid matrix Power Amplifier (HMPA) 14 the functions of which are described below. The basis for selecting the LLBFN output ports to which HMPA input ports will also be explained below.

The hybrid matrix power amplifier 14 comprises a 4×4 input hybrid matrix 16 feeding a power amplifier section 18 which in turn feeds a 4×4 output hybrid matrix 20 which is identical to matrix 16. The power amplifier section 18 comprises individual amplifiers (PA) 22 respectively connected between each output port of matrix 16 and the corresponding input port of matrix 20. The output ports of matrix 20 are connected respectively to four radiating elements 24 in a particular manner described below. The radiating elements 24, which may be horns or other types of radiator, are clustered about the focal point of a parabolic reflector 26. The fact that the radiating elements 24 are positioned at different physical locations with respect to the reflector focal point gives rise to the formation of separate beams.

The hybrid matrix for this type of application consists of 90 degree, 3 dB hybrids. The properties of the matrix are such that:

(a) A signal input at any port will be divided equally at all output ports but with relative phases varying by multiples of 90 degrees.

(b) If the output signal components from the first (input) matrix, without change of their relative phases, are fed into a second (output) identical matrix, they will be summed at the corresponding complementary port (skew symmetrical) without loss.

Figure 2:
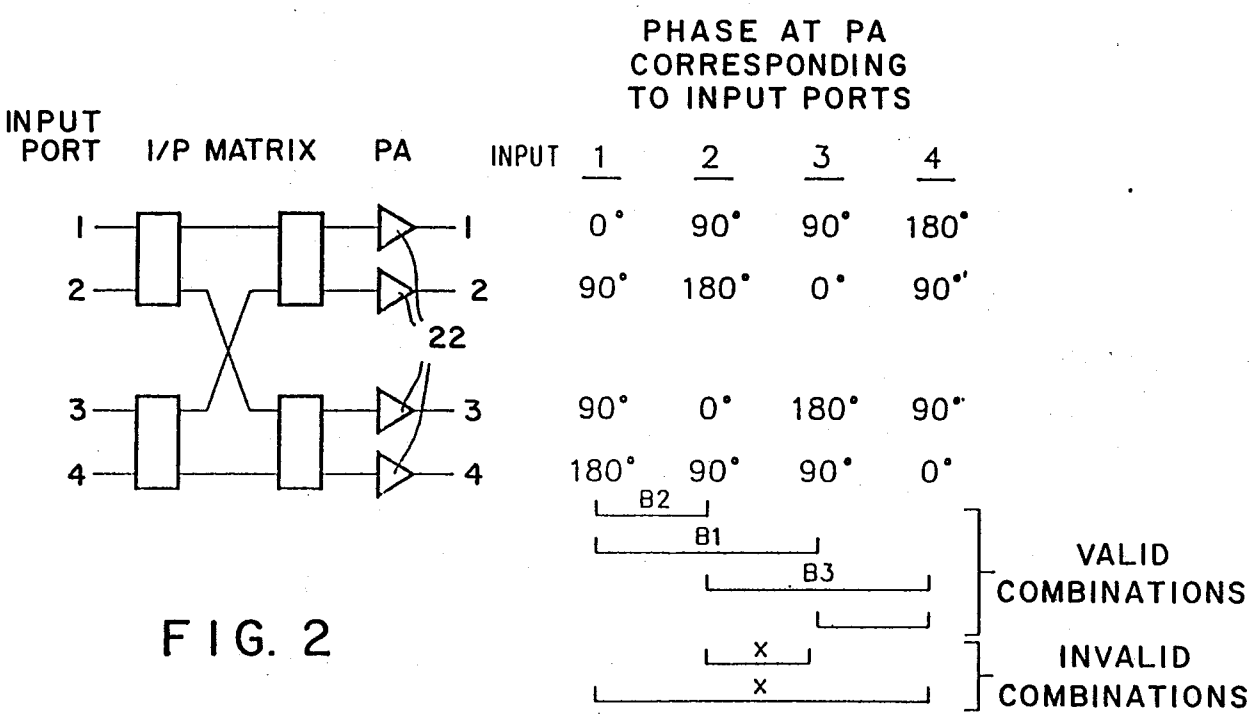
FIG. 2 shows how coherent signal phases are selected at the power amplifiers in the system of FIG. 1.

The output phases of the signal corresponding to each of the input ports of the input matrix 16 are presented in FIG. 2. The indicated phase values assume equal paths of interconnecting transmission lines between hybrids. The implied positive phase angle has no significance in this analysis since it is only the phase difference which is important.

If all four inputs to the matrix of FIG. 2 were independent signals, then each PA 22 would see an average power loading equal to the arithmetic sum of the four power components associated with the input ports. However, if some of the input signals to the matrix were coherent, then depending on their phase angles at the PA section 18, loading might not be uniform across all PA's 22. For example, if two equal signals at matrix input ports 1 and 4 were coherent and had the same phase, complete signal cancellation would have taken place at PA's 1 and 4 while in PA's 2 and 3 two in-phase components would have generated twice the average loading. Maintaining equal or as nearly equal as possible loading on the PA's 22 in the presence of coherent signals is the essence of this invention. Equal PA loading implies that the smallest, lightest and most power efficient PA can be used for a given application. Major cost savings can result from this, mainly due to lower mass and power requirements on the spacecraft bus and partly due to lower production costs of a smaller PA unit.

As can be seen by inspection of FIG. 2, from the 6 possible ways that sets of two input matrix ports can be selected only 4 ways lead to equal PA loading and are considered valid combinations for this method. The remaining two combinations produce double the average power in two of the PA's while two other PA's carry no power. All combinations with two coherent components at quadrature in each PA are valid since they produce equal power amplifier loading; these are 1 and 2, 1 and 3, 2 and 4, and 3 and 4. Invalid combinations are 1 and 4 and 2 and 3.

The above analysis explains the choice of interconnections between LLBFN 10 and HMPA 14 and between HMPA 14 and the antenna feed elements 24 in the 3 beam example of FIG. 1. Three of the four possible valid combinations as indicated in FIG. 2 have been selected for equal PA loading. Also beam overlap has been achieved by the center two elements 24 being shared between two beams.

More particularly, valid combinations 1 and 2, 1 and 3 and 2 and 4 have been selected in the present case. Thus, outputs 1, 2, 3 add 4 of LLBFN 10 have been connected, respectively, to input ports 3, 1, 2 and 4 of input matrix 16. This means that input matrix port 1 carries portions of beam signals 1 and 2, input matrix port 2 carries portions of beam signals 2 and 3, input matrix port 3 carries only a portion of beam signal 1 and input matrix port 4 carries only a portion of beam signal 3. Thus, any radiating elements supplied by input ports 1 and 2 would be supplied by all of beam signal 2, any radiating elements supplied by ports 1 and 3 would be supplied by all of beam signal 1 and any radiating elements supplied by ports 2 and 4 would be supplied by all of beam signal 3. To achieve this and the desired beam overlap the radiating elements 24 numbered upwardly from the bottom as 1, 2, 3 and 4 are connected to the output ports of output matrix as follows: radiating element 1 is connected to port 3, radiating element 2 is connected to port 1, radiating element 3 is connected to port 2 and radiating element 4 is connected to port 4.

Because of the properties of input and output matrices as explained above this is the same as saying that radiating elements 1 and 2 are connected to input ports 3 and 1, respectively of input matrix 16. Thus all of beam signal 1 is radiated as beam B1 from radiating elements 1 and 2. Similarly, radiating elements 2 and 3 are effectively supplied by ports 1 and 2 of input matrix 16 meaning that these two radiating elements radiate beam B2 carrying all of beam signal 2. Similarly radiating elements 3 and 4 radiate a beam B3 which carries all of beam signal 3.

RF power assignment flexibility is one of the key properties of the hybrid matrix PA. A signal applied to any input port is divided equally across the PA's and summed again at the complementary output port. The amount of power taken from the PA's by such signal can be varied arbitrarily from zero to the combined maximum of all the PA's. The same degree of power assignment flexibility can be provided in the case of beam forming signals going through the matrix PA as long as the coherence problem has been addressed as in the example of FIG. 1.

Power assignment with beam forming signals has, of course, significance only on a beam basis. By varying the beam drive level more or less power is assigned to that beam.

The concept described can be expanded to suit a variety of applications which share some or all of the following characteristics and requirements.

1. Require high antenna gain achievable only with a number of spot beams.
2. Cross-over gain between spot beams is critical.
3. Require large amounts of power.
4. Require considerable power assignment flexibility between beams without significant loss of power efficiency.
5. Can tolerate multicarrier operation in a common PA. More particularly, this type of transmitter is suitable for systems which have to operate in a linear mode due to the nature of the signal which contains a number of carriers (sometimes a quite large number of carriers). Whether individual power amplifiers (PA) or a matrix amplifier are used the requirement for linear operation is the same. Therefore, when a plurality of beam signals are combined through the matrix on a PA the linearity requirements on that PA do not change because it already had to operate in a linear mode.

At present, the general category of upcoming mobile satellite systems is considered prime candidates for this concept. Large systems such as the one presented in FIGS. 3 and 4 have been analyzed and their technical feasibility confirmed. The principles involved are exactly the same as employed in the configuration of FIG. 1 and 2 and accordingly, a detailed description of the embodiment illustrated in FIGS. 3 and 4 is considered unnecessary.

Figure 3:
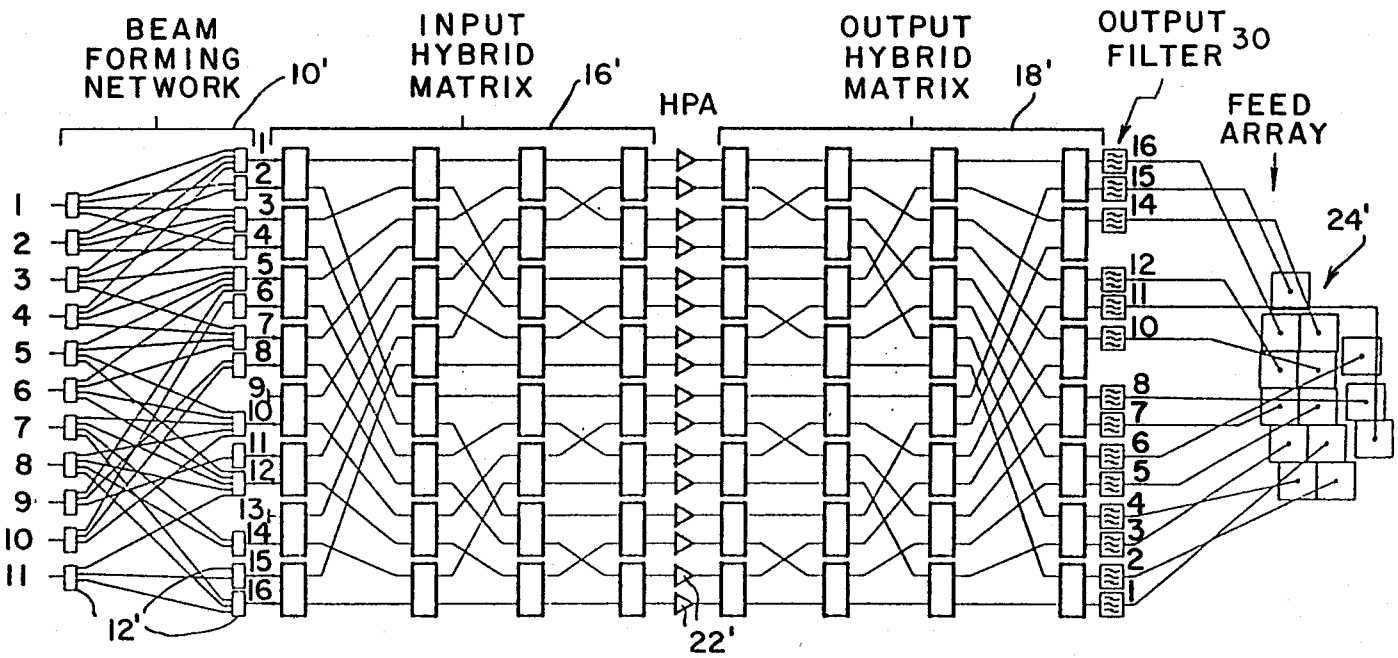
FIG. 3 is a diagram similar to FIG. 1 but involving the use of many more beams.
Figure 4:
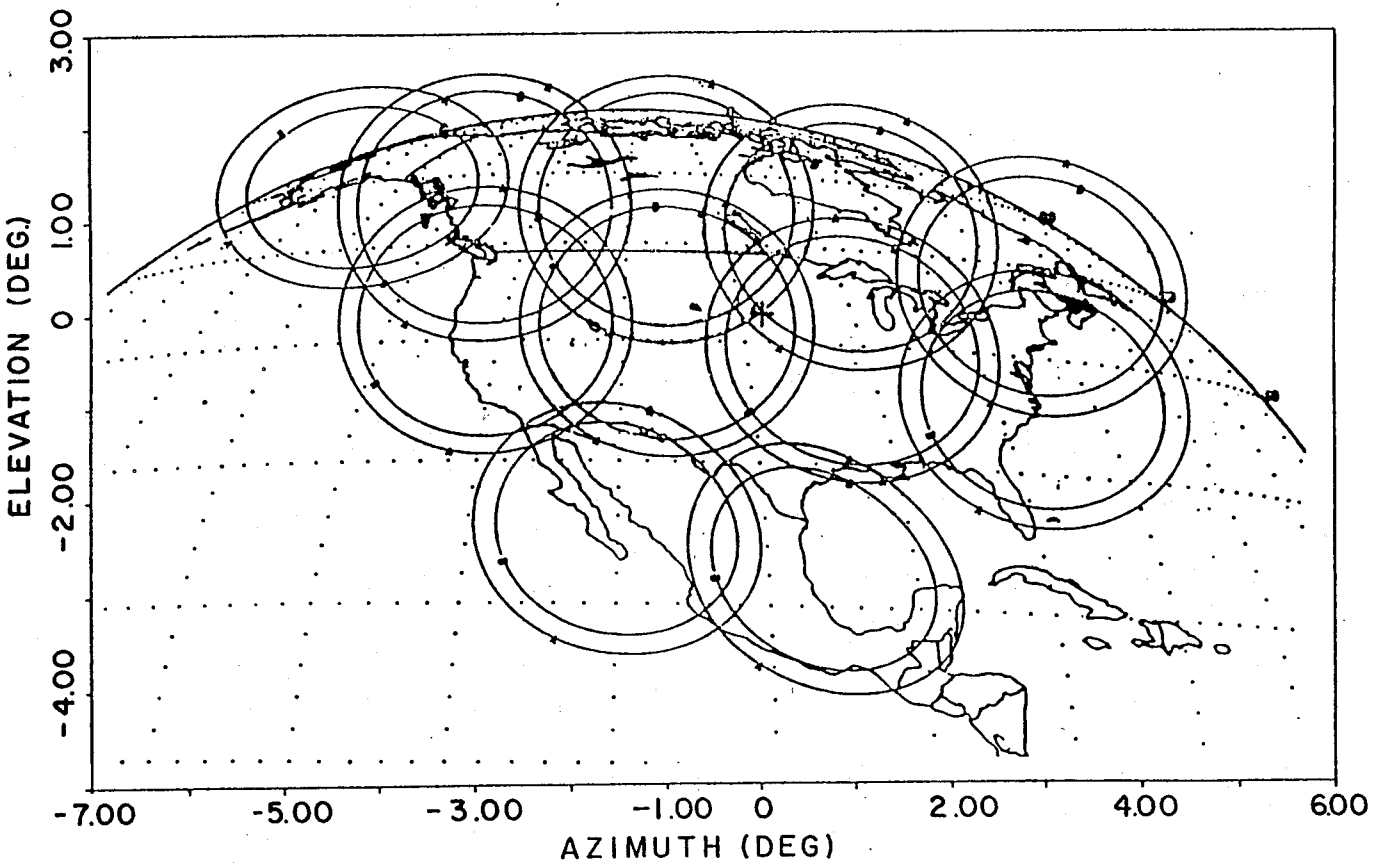
FIG. 4 illustrates the antenna coverage obtained by the system of FIG. 3.

The system of FIG. 3 consists of eleven overlapping beams and employs unequal power split between the feed elements of a beam. Selection of valid matrix port combinations and fitting of valid combinations to generate the desired system beam pattern is done by appropriate computer programs. (See Appendix A attached hereto.) In the example shown a cluster of fourteen radiating elements 24' is used to generate the eleven beams. The radiating elements 24' are positioned as appropriate with reference to the focal point of the antenna reflector (not shown). The input and output hybrid matrices 16' and 18' are each 16 port hybrids rather than the 4 port hybrids shown in FIGS. 1 and 2. Two of the ports (namely 9 and 13) have no input signal applied to them and, therefore, no output signal obtained therefrom. The LLBFN 10' has eleven input ports and fourteen output ports interconnected by couplers 12'. It is noted that, as in the generalized configuration of FIG. 1, the number of radiating elements 24' is the same as the number of output ports of LLBFN 10'.

FIG. 3 illustrates the use of output filters 30 which, although not a part of the inventive concept, are essential to the operation of a real system. Such filters, although not shown in FIG. 1, would be present in a practical system. Where perfectly equal PA loading is not possible, as in the case of beams with odd number of feed elements, the developed computer programs help with the selection of the most uniform loading configurations. With some judicious choice of feed elements per beam and beam power split over these feed elements per beam the key advantages of this concept can be maintained essentially intact.

Various modifications and variations will no doubt occur to those skilled in the art to which the invention pertains. For example, the individual components such as the LLBFN and the HMPA, could be implemented in different forms without affecting the inventive concept. Particular illustrative examples are (a) discrete coaxial components interconnected with detachable cables, (b) stripline construction with all couplers and lines continuously laid out, (c) discrete waveguide components and (d) continuous TEM line box assembly. Similarly, the radiating elements could, for example, be in the form of (a) waveguide horns, (b) cross dipole horns, (c) helices and (d) patch radiators and could be circular, square or have another shape of aperture.

The selection and specific design of these components for implementation in a satellite of the invention represent routine engineering principles which form no part of the invention.

Although in the embodiments described the number of radiating elements exceeds the number of beams, this need not necessarily be so and, for example, a four beam system could be implemented using three radiating elements. The ratio of beams to radiating elements depends on the amount of overlap, the complexity of the coverage area and possibly the electrical size (number of wavelengths) of the radiating elements.

Finally, although the embodiments described illustrate a single radiating element connected to each specific output of the HMPA, it is to be understood that each radiating element 24 or 24' could in reality be constituted by a pair of radiating elements (or even more) both located at approximately the same position with reference to the antenna focal point.

Appendix A comprises three technical memoranda, 600-03 entitled OPTIMUM INPUT GROUPINGS OF THE HYBRID MATRIX AMPLIFIER, 600-05 entitled DETERMINATION OF MATRIX AMPLIFIER INPUT COMBINATIONS and 600-06 entitled OPTIMUM INPUT GROUPINGS OF THE HYBRID MATRIX AMPLIFIER FOR UNEQUAL INPUT VOLTAGES.

What we claim as our invention is:

1. An overlapping beam, power versatile system for a communications satellite comprising a low level beam forming network having inputs to which a plurality of individual beam signals are respectively applied, the beam forming network having a plurality of outputs, some of which respectively carry the sum of components of more than one input signal, a hybrid matrix power amplifier having input ports respectively connected to the outputs of the low level beam forming network and having complementary output ports respectively connected to a plurality of radiating elements of the same number as the outputs of the beam forming network, the manner in which the beam signals are combined within the beam forming network, the connections between the outputs of the beam forming network and the input ports of the hybrid matrix power amplifier and the connections between the output ports of the hybrid matrix power amplifier and the radiating elements being determined to achieve substantially equal power amplifier loading and to achieve beam overlap.

2. A system according to claim 1 in which the hybrid matrix power amplifier comprises an input hybrid matrix having input ports and output ports, an output hybrid matrix having input ports and output ports and a power amplifier section comprising individual amplifiers respectively connected between the output ports of the input hybrid matrix and the corresponding input ports of the output hybrid matrix, the input ports of the input hybrid matrix serving as the input ports of the hybrid matrix power amplifier and the output ports of the output hybrid matrix serving as the output ports of the hybrid matrix power amplifier.

3. A system according to claim 2 in which each hybrid matrix comprises 90 degree, 3 dB hybrids.

4. A system according to claim 3 in which the number of radiating elements is greater than the number of individual beam signals.

5. A system according to claim 3 in which output filters are connected respectively between the output ports of the hybrid matrix power amplifier and the radiating elements.

6. A system according to claim 5 in which there are four radiating elements arranged in three pairs proximate the focal point of an antenna reflector and three individual beam signals, each beam signal being divided between each pair thereby providing overlap between a first two of the beams and between a second two of the beams.

7. A system according to claim 6 in which the hybrid matrix power amplifier has four input ports and four output ports.

8. A system according to claim 5 in which there are fourteen radiating elements arranged proximate the focal point of a radiating elements arranged proximate the focal point of an antenna reflector and eleven individual beam signals.

9. A system according to claim 8 in which the hybrid matrix power amplifier has sixteen input ports, two of which are not used, and sixteen output ports, two of which are not used.

10. An overlapping beam, power versatile system for a communications satellite comprising a parabolic reflector having a focal point, a plurality of radiating positions proximate the focal point, at least one radiating element located at each radiating position, a low level beam forming network having inputs to which a plurality of individual beam signals are respectively applied, the beam forming network having a plurality of outputs of the same number as the radiating positions some of which outputs respectively carry the sum of components of more than one input signal, a hybrid matrix power amplifier having input ports respectively connected to the outputs of the low level beam forming network and having complementary output ports respectively connected to the at least one radiating element at the radiating positions, the selection of which output ports of the hybrid matrix power amplifier are connected to which radiating elements being determined in associated with the manner in which the beam signals are combined within the beam forming network and in association with which output ports of the beam forming network are connected to which input ports of the hybrid matrix amplifier so as to achieve substantially equal power amplifier loading and to achieve beam overlap.

11. A system according to claim 10 in which there are at least two radiating elements at each radiating position, both of the radiating elements being connected to the same hybrid matrix power amplifier output port.

* * * * *